US007236102B2

(12) United States Patent
Shimotani

(10) Patent No.: US 7,236,102 B2
(45) Date of Patent: Jun. 26, 2007

(54) VEHICLE INFORMATION SYSTEM FOR A LOOP INTERSECTION

(75) Inventor: Takashi Shimotani, Obu (JP)

(73) Assignee: Denso Corporation, Kariya-city (JP)

( * ) Notice: Subject to any disclaimer, the term of this patent is extended or adjusted under 35 U.S.C. 154(b) by 173 days.

(21) Appl. No.: 11/105,491

(22) Filed: Apr. 14, 2005

(65) Prior Publication Data

US 2005/0231384 A1 Oct. 20, 2005

(30) Foreign Application Priority Data

Apr. 15, 2004 (JP) ..... 2004-120292

(51) Int. Cl.
*G08G 1/07* (2006.01)

(52) U.S. Cl. ..... 340/917; 340/919; 340/907

(58) Field of Classification Search ..... 340/902, 340/903, 905, 917, 919, 928, 436, 907; 701/53, 701/59, 207, 208
See application file for complete search history.

(56) References Cited

U.S. PATENT DOCUMENTS 4,727,371 A * 2/1988 Wulkowicz ..... 340/917
5,448,219 A 9/1995 Yoshikawa et al. ..... 340/436
5,926,114 A * 7/1999 Andrews ..... 340/909
6,008,741 A * 12/1999 Shinagawa et al. ..... 340/907
6,292,109 B1 * 9/2001 Murano et al. ..... 340/903
6,937,935 B2 * 8/2005 Sato ..... 701/207

FOREIGN PATENT DOCUMENTS

FR 2785435 A1 * 5/2000
JP A-8-106600 4/1996
JP A-2001-143197 5/2001
JP A-2001-167395 6/2001

* cited by examiner

*Primary Examiner*—Van T. Trieu
(74) *Attorney, Agent, or Firm*—Posz Law Group, PLC

(57) ABSTRACT

A driver of a vehicle that is going to enter a loop intersection is allowed to perceive vehicles traveling on a loop road and vehicles that are going to enter the loop intersection from separate roads. Infrared ray sensors for detecting vehicles in the loop intersection, and infrared ray sensors for detecting vehicles that are going to enter the loop intersection from the roads. Billboards equipped with display units at places that can be seen from the roads to display the vehicles that are detected by the infrared ray sensors. Transmitters transmit, to a unit mounted on the vehicle, information related to the detected vehicles, so that the vehicles are displayed on a display unit of the vehicle.

11 Claims, 5 Drawing Sheets

| BILL-BOARD \ SENSOR | #1(7a) | #2(7b) | #3(7c) | #4(7d) | #5(7e) | #6(7f) | #7(7g) | #8(7h) |
|---|---|---|---|---|---|---|---|---|
| #1(9) | ○ | ○ | × | × | × | × | × | ○ |
| #2(10) | × | ○ | ○ | ○ | × | × | × | × |
| #3(11) | × | × | × | ○ | ○ | ○ | × | × |
| #4(12) | × | × | × | × | × | ○ | ○ | ○ |

VEHICLE INFORMATION SYSTEM FOR A LOOP INTERSECTION

CROSS REFERENCE TO RELATED APPLICATION

This application is based on and incorporates herein by reference Japanese Patent Application No. 2004-120292 filed on Apr. 15, 2004.

FIELD OF THE INVENTION

This invention relates to a vehicle information system for a loop intersection which detects vehicles in the loop intersection or vehicles that are going to enter the loop intersection, and notifies the vehicles to other vehicles.

BACKGROUND OF THE INVENTION

As one of traffic intersections, a loop intersection (ring road or runabout) is known. An intersection usually stands for a point where a plurality of roads meets together, and an intersection where a plurality of roads meets together along a circle or ring road is called loop intersection. The loop intersection is one-way, i.e., the loop road is one-way. A vehicle that enters the loop road from a given road connected to the loop road travels the loop road in a predetermined one direction and is allowed to go to any desired road.

A system is proposed for preventing the collision of vehicles in an intersection. In this system, a signal at the intersection is provided with a distance-measuring device, and a device to which the distance is to be measured is mounted on a vehicle that is going to enter the intersection. The distance-measuring device provided on the signal measures a distance between the signal and the other vehicle approaching the intersection, and an alarm is generated in the vehicle when the other vehicle approaches the intersection within a predetermined distance (for example, JP-A-2001-167395).

Another system is proposed for preventing a head-on collision that may happen as vehicles meet together by informing, in real time, all vehicles traveling on the roads and approaching the intersection of the position information and speed information of all vehicles traveling on the road and approaching the intersection (for example, JP-A-2001-143197).

In a loop intersection in many cases, trees are planted and signboards are erected at places surrounded by a loop road. With trees being planted and signboards being erected at places surrounded by the loop road, a driver of a vehicle entering the loop road cannot see the conditions of the loop road on the opposite side since his visual field is interrupted by the trees and the signboards.

Further, if two vehicles enter the loop road from separate roads, the vehicle subsequently entering the loop road may fail to notice the other vehicle that has already entered the loop road and is traveling thereon.

SUMMARY OF THE INVENTION

This invention has its first object to provide a vehicle information system for a loop intersection which enables a driver of a vehicle that is going to enter the loop intersection to perceive a vehicle that is traveling on the loop road.

The invention has its second object to provide a vehicle information system for a loop intersection which enables a driver of a vehicle that is going to enter the loop intersection to perceive a vehicle that is going to enter the loop road from a separate road.

According to the first aspect of the present invention, a vehicle information system detects a traveling vehicle traveling in a loop intersection, and notifies the traveling vehicle to an approaching vehicle that is going to enter the loop intersection from one of a plurality of roads connected to the loop intersection, when the traveling vehicle is detected.

According to the second aspect of the present invention, a vehicle information system detects an approaching vehicle that is going to enter a loop intersection from one of a plurality of roads, and, when the approaching vehicle is detected, notifies another approaching vehicle which is going to enter the loop intersection from another road of the plurality of roads which is neighboring to the one of the plurality of roads on which the approaching vehicle is detected in a predetermined traveling direction in the loop intersection.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENT

Figure 1A:
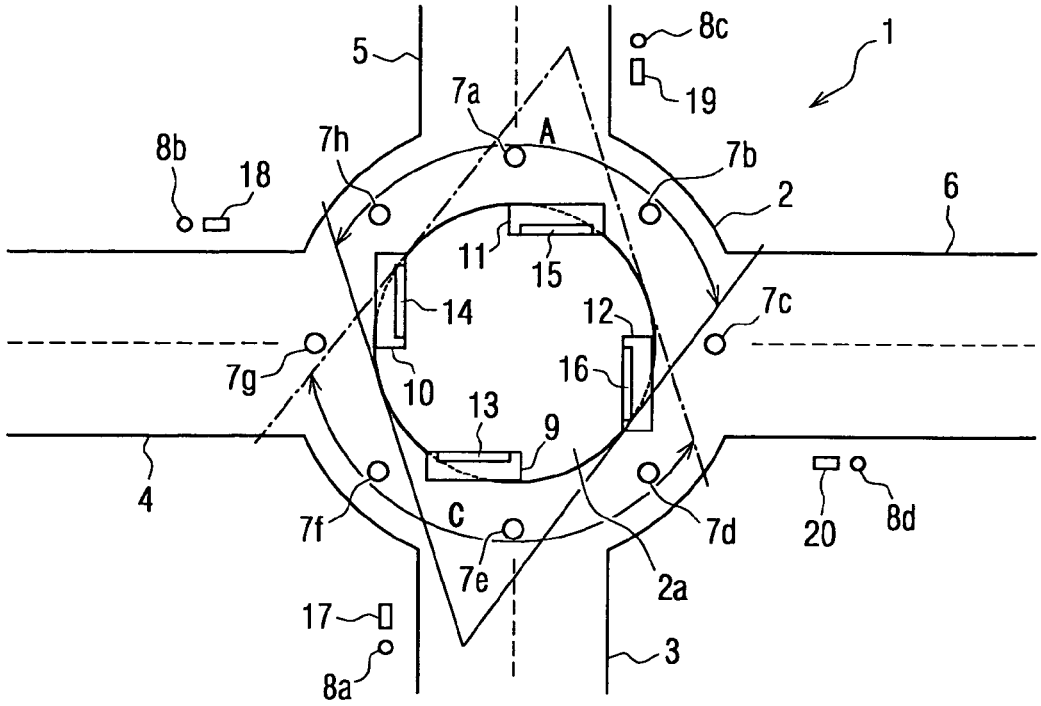
FIGS. 1A and 1B are schematic views of a loop intersection according to an embodiment of the present invention.
Figure 1B:
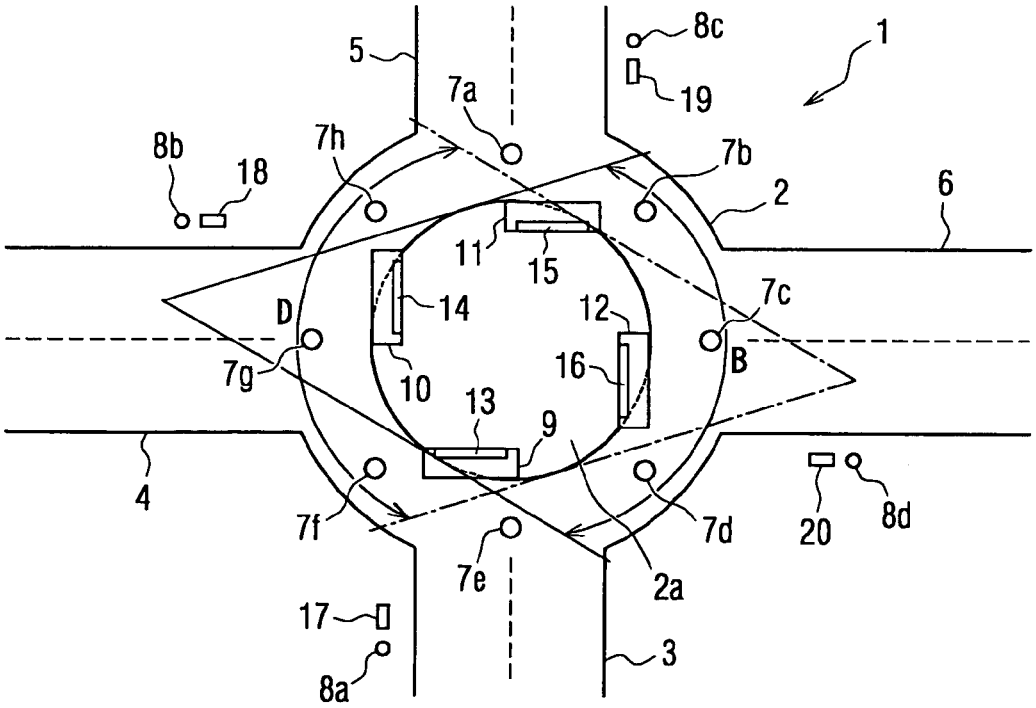

Referring to FIGS. 1A and 1B, a loop intersection (traffic circle or roundabout) 1 is shown as being connected to four roads 3 to 6 along a loop road 2. The four roads 3 to 6 are all two-way traffic roads with one lane on either side.

In the loop intersection 1, i.e., on the loop road 2, the traffic rule is that each vehicle shall travel one-way, e.g., in a clockwise direction. The traffic rule is further that each vehicle traveling on the loop road 2 has priority, and a vehicle that is going to enter the loop road 2 shall not affect vehicles that are traveling on the loop road 2.

On a place surrounded by the loop road 2 (central vacant land) 2*a*, for example, trees are planted. For a driver of a vehicle traveling on the first road 3 toward the loop road 2, therefore, the trees cause a dead angle over a region represented by A in FIG. 1A on the opposite side of the central vacant land 2*a* out of the whole loop road 2. Further, for a driver of a vehicle traveling on the second road 4 toward the loop road 2, a dead angle is caused over a region represented by B in FIG. 1B out of the whole loop road 2. Similarly, for a driver of a vehicle traveling on the third road 5 toward the loop road 2, a dead angle is caused over a region represented by C in FIG. 1A out of the whole loop road 2. For a driver of a vehicle traveling on the fourth road 6 toward the loop road 2, a dead angle is caused over a region represented by D in FIG. 1B out of the whole loop road 2.

In the loop intersection 1, a plurality of vehicle detecting devices is provided for detecting traveling vehicles traveling on the loop road 2. Specifically, for example, eight infrared ray sensors 7*a* to 7*h* for detecting the vehicles in the intersection 1. The first (#1) to eighth (#8) infrared ray sensors 7*a* to 7*h* for detecting the traveling vehicles in the intersection 1 are provided with a light-emitting element and a light-receiving element that are not shown, and detect whether the vehicles are existing (traveling) on the loop road 2 based on a time from when the infrared ray is emitted from the light-emitting element until when it is reflected by a body and is received by the light-receiving element.

That is, when no vehicle is on the loop road 2, the light-receiving element receives no reflected infrared ray, or the time from when the infrared ray is emitted from the light-emitting element until when the reflected infrared ray is received by the light-receiving element exceeds a predetermined period of time. If a vehicle is present on the loop road 2, the time from when the infrared ray is emitted from the light-emitting element until when the reflected infrared ray is received by the light-receiving element becomes shorter than the predetermined period of time.

The infrared ray sensors 7*a* to 7*h* for detecting the traveling vehicles in the intersection are installed to exist in a number of three in each of the regions A to D which are dead angles for the drivers of the vehicles traveling on the roads 3 to 6 toward the loop road 2.

Near the portions where the roads 3 to 6 connect to the loop road 2, the first (#1) to fourth (#4) infrared ray sensors 8*a* to 8*d* for detecting approaching vehicles approaching to the intersection 1. The infrared ray sensors 8*a* to 8*d* are for detecting the approaching vehicles entering into the loop road 2 from the roads 3 to 6, and work as devices for detecting the vehicles approaching the intersection 1.

On the central vacant land 2*a* surrounded by the loop road 2, there are installed billboards as notifying devices, specifically, a plurality of, for example, four billboards 9 to 12 (#1 to #4) facing the roads 3 to 6. The first to fourth billboards 9 to 12 are provided with first to fourth large-screen display units 13 to 16 (FIG. 2) for outdoor use. The large-screen display units 13 to 16 for outdoor use employ, for example, highly bright LEDs as display elements. Near the portions where the roads 3 to 6 connect to the loop road 2, further, there are arranged first to fourth transmitters 17 to 20.

Figure 2:
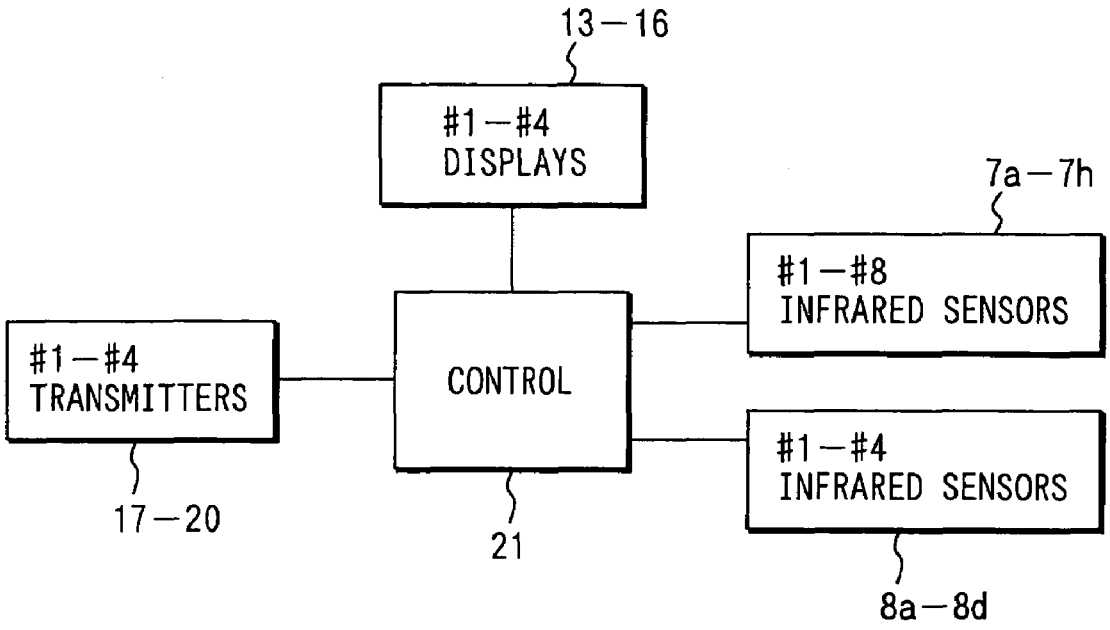
FIG. 2 is a block diagram of a vehicle detecting device used in the embodiment.

Referring to FIG. 2, the first to eighth infrared ray sensors 7*a* to 7*h* for detecting the vehicles in the intersection 1, the first to fourth infrared ray sensors 8*a* to 8*d* for detecting the vehicles approaching the intersection 1, the first to fourth large-screen display units 13 to 16 for outdoor use, and the first to fourth transmitters 17 to 20, are connected to a control circuit 21. Upon receipt of detection signals from the infrared ray sensors 7*a* to 7*h* for detecting the vehicles in the intersection 1 and from the infrared ray sensors 8*a* to 8*d* for detecting the vehicles approaching the intersection 1, the control circuit 21 sends instructions to have the display unit of the billboard corresponding to the infrared ray sensor that has produced a vehicle detection signal display the fact that a vehicle is existing (traveling) among the display units 13 to 16 of the first to fourth billboards 9 to 12, and to have the transmitter corresponding to the infrared ray sensor producing the vehicle detection signal transmit a signal that represents the presence of the vehicle.

Figures 4, 5:
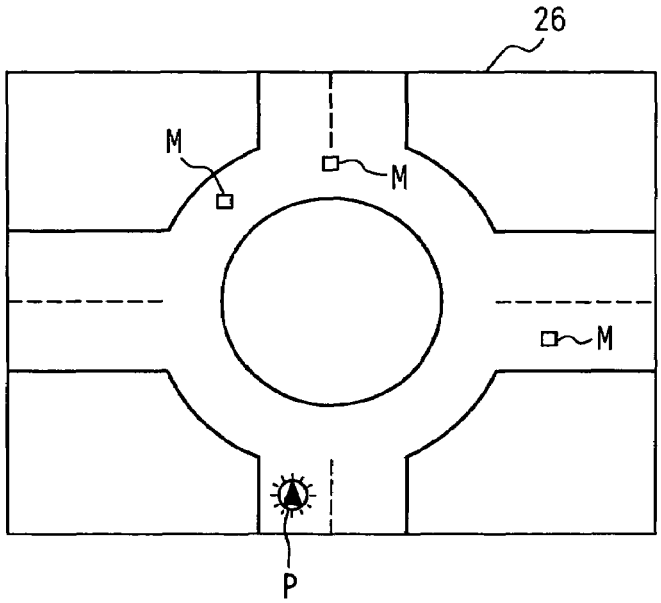
FIG. 4 is a table illustrating relationships between infrared ray sensors for detecting vehicles in an intersection and billboards that display the detection.
FIG. 5 is a schematic view illustrating a state of display of a display device of the vehicle-mounted unit.

Referring to FIG. 4, when, for example, the infrared ray sensor 7*a* has produced a vehicle detection signal among the infrared ray sensors 7*a* to 7*h*, a display "VEHICLE IS TRAVELING ON THE OPPOSITE SIDE" is made on the display unit 13 of the first billboard 9 in front that can be seen from the first road 3 and an instruction is sent to the first transmitter 17 of the first road 3 to produce a signal (information) that states "vehicle is traveling on the opposite side". This display is indicated with a circle mark (○) in the figure. When the infrared ray sensor 7*b* has produced a vehicle detection signal, a display "VEHICLE IS TRAVELING ON THE OPPOSITE SIDE" is made on the display units 13 and 14 of the first and second billboards 9 and 10 in front of the first and second roads 3 and 4, and an instruction is sent to the first and second transmitters 17 and 18 of the first and second roads 3 and 4 to produce a signal that states "vehicle is traveling on the opposite side".

Hereinafter, when the infrared ray sensor 7*c* has produced a vehicle detection signal, a display "VEHICLE IS TRAVELING ON THE OPPOSITE SIDE" is made on the display unit 14 of the second billboard 10 in front of the second road 4, and an instruction is sent to the second transmitter 18 of the second road 4 to produce a signal that states "vehicle is traveling on the opposite side". When the infrared ray sensor 7*d* has produced a vehicle detection signal, a display "VEHICLE IS TRAVELING ON THE OPPOSITE SIDE" is made on the display units 14 and 15 of the second and third billboards 10 and 11 in front of the second and third roads 4 and 5, and an instruction is sent to the second and third transmitters 18 and 19 of the second and third roads 4 and 5 to produce a signal that states "vehicle is traveling on the opposite side".

When the infrared ray sensor 7*e* has produced a vehicle detection signal, a display "VEHICLE IS TRAVELING ON THE OPPOSITE SIDE" is made on the display unit 15 of the third billboard 11 in front of the third road 5, and an instruction is sent to the third transmitter 19 of the third road 5 to produce a signal that states "vehicle is traveling on the opposite side". When the infrared ray sensor 7*f* has produced a vehicle detection signal, a display "VEHICLE IS TRAVELING ON THE OPPOSITE SIDE" is made on the display units 15 and 16 of the third and fourth billboards 11 and 12 in front of the third and fourth roads 5 and 6, and an instruction is sent to the third and fourth transmitters 19 and 20 of the third and fourth roads 5 and 6 to produce a signal that states "vehicle is traveling on the opposite side".

When the infrared ray sensor 7*g* has produced a vehicle detection signal, a display "VEHICLE IS TRAVELING ON THE OPPOSITE SIDE" is made on the display unit 16 of the fourth billboard 12 in front of the fourth road 6, and an instruction is sent to the fourth transmitter 20 of the fourth road 6 to produce a signal that states "vehicle is traveling on the opposite side". When the infrared ray sensor 7*h* has produced a vehicle detection signal, a display "VEHICLE IS TRAVELING ON THE OPPOSITE SIDE" is made on the display units 16 and 13 of the fourth and first billboards 12 and 9 in front of the fourth and first roads 6 and 3, and an instruction is sent to the fourth and first transmitters 20 and 17 of the fourth and first roads 6 and 3 to produce a signal that states "vehicle is traveling on the opposite side".

Further, when the infrared ray sensor 8*a* of the first road 3 has produced a vehicle detection signal among the infrared ray sensors 8*a* to 8*d* for detecting the vehicles approaching the intersection 1, a display "VEHICLE IS ENTERING INTO THE INTERSECTION FROM THE RIGHT NEIGHBORING ROAD" is made on the display unit 14 of the billboard 10 in front of the second road 4 which is neighboring in a predetermined traveling direction on the loop road 2, i.e., which is neighboring in the clockwise direction in relation to the first road 3, and an instruction is sent to the second transmitter 18 of the second road 4 to produce a signal that states "vehicle is entering into the intersection from the right neighboring road".

Similarly, hereinafter, when the infrared ray sensor 8*b* of the second road 4 has produced a vehicle detection signal, a display "VEHICLE IS ENTERING INTO THE INTERSECTION FROM THE RIGHT NEIGHBORING ROAD" is made on the display unit 15 of the billboard 11 in front of the third road 5 which is neighboring in the clockwise direction, and an instruction is sent to the third transmitter 19 of the third road 5 to produce a signal that states "vehicle is entering into the intersection from the right neighboring road".

When the infrared ray sensor 8*c* of the third road 5 has produced a vehicle detection signal, a display "VEHICLE IS ENTERING INTO THE INTERSECTION FROM THE RIGHT NEIGHBORING ROAD" is made on the display unit 16 of the billboard 12 in front of the fourth road 6 which is neighboring in the clockwise direction, and an instruction is sent to the fourth transmitter 20 to produce a signal that states "vehicle is entering into the intersection from the right neighboring road".

When the infrared ray sensor 8*d* of the fourth road 6 has produced a vehicle detection signal, a display "VEHICLE IS ENTERING INTO THE INTERSECTION FROM THE RIGHT NEIGHBORING ROAD" is made on the display unit 13 of the billboard 9 in front of the first road 3 which is neighboring in the clockwise direction, and an instruction is sent to the first transmitter 17 to produce a signal that states "vehicle is entering into the intersection from the right neighboring road".

Figure 3:
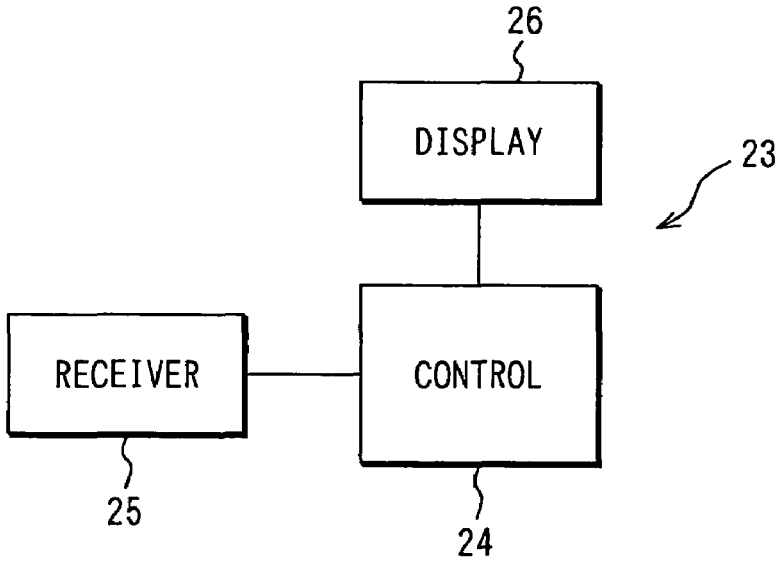
FIG. 3 is a block diagram of a vehicle-mounted unit used in the embodiment.

A vehicle-mounted unit 23 illustrated in FIG. 3 is mounted on a vehicle 22. The vehicle-mounted unit 23 is constituted by connecting, to a control circuit 24, a receiver 25 which is receiving means for receiving electromagnetic signals from the first to fourth transmitters 17 to 20, and a display unit 26 comprising, for example, a liquid crystal. Among them, the display unit 26 is arranged at a position where it can be easily seen from the driver's seat. The transmitters 17 to 20 and the receiver 25 are those of a short range communication system. Therefore, the communication areas of the transmitters 17 to 20 do not include other roads than the roads on which the transmitters 17 to 20 are installed.

The receiver 25 receives electromagnetic wave signals transmitted from the transmitters 17 to 20, and sends the received information to the control circuit 21. The control circuit 24 displays, on the display unit 26, the information received through the receiver 25. In this case, as shown in FIG. 5, the display unit 26 displays the loop intersection 2 and the roads 3 to 6 connected to the loop intersection 2 with the direction of travel of the vehicle which is headed upward in the figure, a position mark P representing such a vehicle is displayed, and marks M representing other vehicles that are detected. The display positions of the marks M have been set to be nearly in agreement with the positions of the infrared ray sensors that have detected the vehicles.

Next, the operation of the embodiment will be described with further reference to the flowcharts of FIGS. 6 and 7.

The infrared ray sensors 7*a* to 7*h* and 8*a* to 8*c* executes the operation for detecting the vehicles at all times. The control circuit 21 alternately and repetitively executes a routine for detecting the vehicles in the intersection illustrated in FIG. 6 and a routine for detecting the vehicles approaching the intersection illustrated in FIG. 7.

Figure 6:
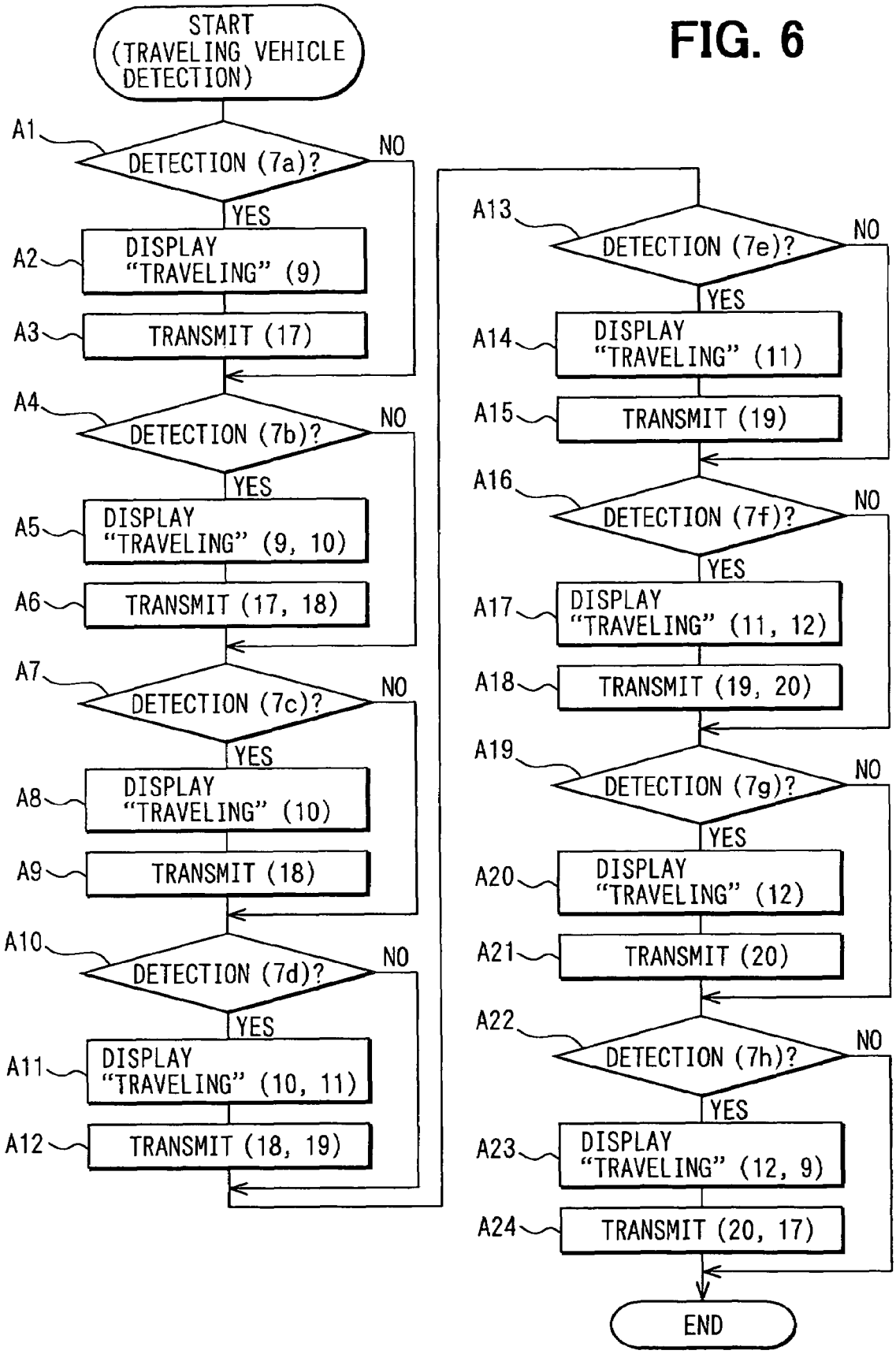
FIG. 6 is a flowchart for detecting a vehicle in the intersection in the embodiment.

Upon starting the routine of FIG. 6, the control circuit 21 determines whether the infrared ray sensors 7*a* to 7*h* have produced detection signals (steps A1, A4, A7, A10, A13, A19 and A22). When any one of the infrared ray sensors produces a detection signal, the control circuit 21 operates to have the display device of the billboard corresponding to the infrared ray sensor that has produced the detection signal make a display "VEHICLE IS TRAVELING ON THE OPPOSITE SIDE" among the display devices 13 to 16 of the plurality of billboards 9 to 12 (steps A2, A5, A8, A11, A14, A20, A23) and to have the transmitter transmit the information stating that the infrared ray sensor has detected the vehicle (steps A3, A6, A9, A12, A15, A22, A24).

The information transmitted from the transmitter is received by the receiver 25 in the vehicle-mounted unit 23 mounted on the vehicle 22. Then, based on the information received by the receiver 25, the control circuit 24 indicates, as shown in FIG. 5, the positions where the vehicles are existing by displaying marks M at places which are nearly in agreement with the positions of the infrared ray sensors that have detected the vehicles on a figure of the loop road 2 and the roads 3 to 6 displayed on the display unit 26.

On the loop road 2 shown in FIG. 5, the other vehicles are traveling on the side opposite to the position P of the vehicle. An example of a control operation for displaying the positions of the vehicles is shown in FIG. 7. First, the transmitters 17 to 20 transmit the information of the positions of the infrared ray sensors 7*a* to 7*h* with the transmitters 17 to 20 as references. When a vehicle is detected, the transmitters 17 to 20 transmit ID information indicating the infrared ray sensor that has detected the vehicle. The control circuit 24 in the vehicle-mounted unit 23 calculates the position of the infrared ray sensor that has detected the vehicle based on the position information with the transmitters 17 to 20 as references, and displays it on the display unit 26.

Figure 7:
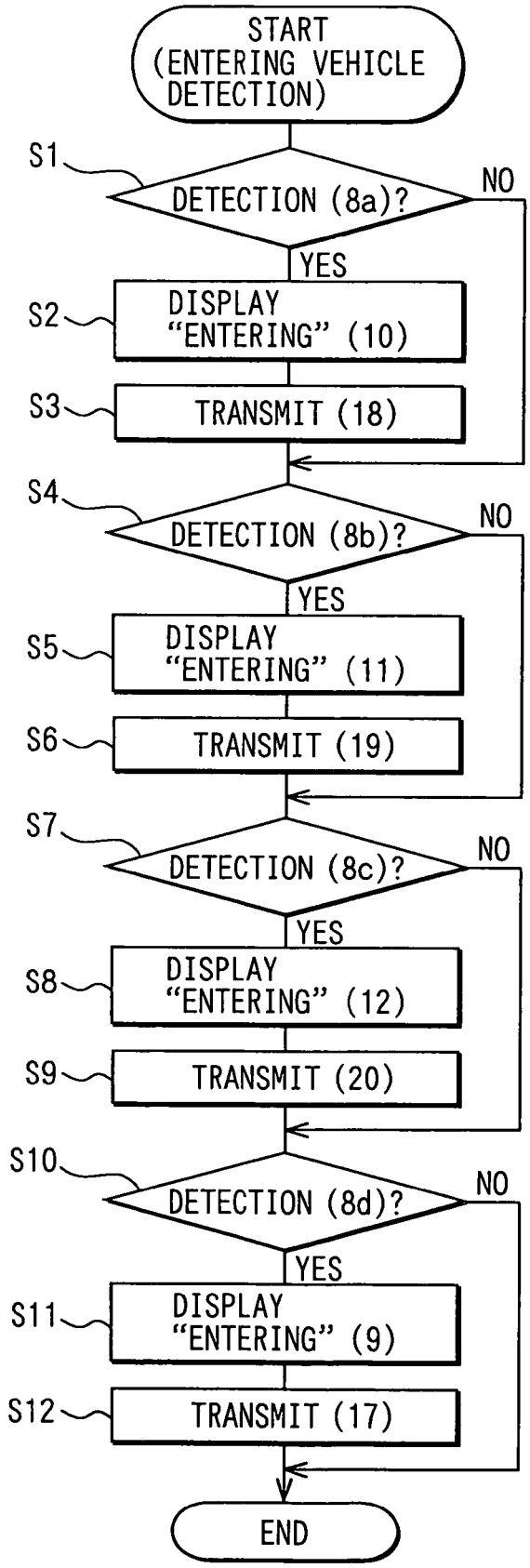
FIG. 7 is a flowchart for detecting a vehicle that is approaching the intersection in the embodiment.

Upon entering into the routine of FIG. 7, on the other hand, the control circuit 21 determines whether the infrared ray sensors 8*a* to 8*d* have produced detection signals (steps S1, S4, S7, S10). If any one of the infrared ray sensors produces a detection signal, the control circuit 21 operates to make a display "VEHICLE IS ENTERING INTO THE INTERSECTION FROM THE NEIGHBORING ROAD" on the display unit of the billboard positioned in front of the neighboring road in the traveling direction of the loop road 2 in relation to the road on where the infrared ray sensor that has produced the detection signal is installed among the display units 13 to 16 of the plurality of billboards 9 to 12 (steps S2, S5, S8, S11).

Next, the control circuit 21 sends an instruction to the transmitter of the neighboring road in the predetermined traveling direction of the loop road 2 to produce information stating "vehicle is entering into the intersection from the neighboring road" in relation to the road on where there is installed the infrared ray sensor that has produced the detection signal. Therefore, the transmitter transmits information "vehicle is entering into the intersection from the right neighboring road". The information transmitted from the transmitter is received by the receiver 25 of the vehicle-mounted unit 23 mounted on the vehicle 22. Based upon the information received by the receiver 25, therefore, the control circuit 24 indicates the positions where the vehicles are existing by indicating marks M on the detection areas of the infrared ray sensors that have detected the vehicles on a figure of the loop road 2 and the roads 3 to 6 displayed on the display unit 26.

The drivers of the vehicles who are going to enter the loop road 2 from the roads 3 to 6 may not be able to see the vehicles that are traveling in the areas of dead angles which are on the opposite side due to trees planted on the central vacant land 2*a* of the loop intersection 1. Even in such a case according to this embodiment, the infrared ray sensors 7*a* to 7*h* detect the vehicles to display them on the display units 13 to 16 of the billboards 9 to 12, and the presence of other vehicles is displayed on the display unit 26, too, of the vehicle-mounted unit 23. This makes it possible to effectively prevent the occurrence of such accidents that a vehicle that is going to enter the loop load 2 comes in contact with a vehicle that is traveling on the loop road 2.

Further, when a plurality of vehicles are going to enter the loop road 2 from the roads 3 to 6 simultaneously, the vehicles are displayed on the display unit 26 of the vehicle-mounted unit 23, effectively prevent the probability of collision between the vehicles that are going to enter the loop road 2 simultaneously.

The invention is in no way limited to the disclosed embodiment but can further be modified as follows.

The sensors for detecting the vehicles are not limited to the infrared ray sensors but may also be ultrasonic sensors or optical sensors.

The vehicle-mounted unit 23 may be omitted if there are the billboards 9 to 12. The billboards 9 to 12 may be omitted if each vehicle is equipped with the vehicle-mounted unit 23.

The vehicle-mounted unit 23 may be a car navigation device. In case of the car navigation device, the present position of the vehicle is detected by a position detecting device such as a GPS receiver. Therefore, the position of the vehicle may be indicated on the screen that shows the loop intersection.

The display units 13 to 16 in the billboards 9 to 12 are not limited to the large-screen display units for outdoor use employing highly bright LEDs.

The notifying means are not limited to the billboards 9 to 12 provided with display units 13 to 16, but may be those which notify the driver by sound.

The display unit 26 of the vehicle-mounted unit 23 may be replaced with the one which notifies by sound.

The roads connecting to the loop road may be one-way roads.

What is claimed is:

1. A vehicle information system for a loop intersection to which a plurality of roads is connected, the vehicle information system comprising:

traveling vehicle detecting means for detecting a traveling vehicle traveling in the loop intersection, wherein the loop intersection is a traffic circle in a rotary shape;

notifying means which notifies traffic condition in the loop intersection; and control means which, when the traveling vehicle detecting means detects the traveling vehicle, notifies the traveling vehicle to an approaching vehicle that is going to enter the loop intersection from one of the plurality of roads, wherein the loop intersection corresponds to a traffic rule defining that the traveling vehicle traveling in the loop intersection has priority over the approaching vehicle entering into the loop intersection so that the traveling vehicle is not affected by the approaching vehicle.

2. The vehicle information system according to claim 1, wherein:

the traveling vehicle detecting means covers, as a detection area, a region that forms a dead angle for the approaching vehicle out of the areas in the loop intersection; and the notifying means includes billboard means that is installed in the loop intersection and is equipped with display units for providing a visual display of the traveling vehicle.

3. The vehicle information system according to claim 2, wherein the region that forms the dead angle is an area of the loop intersection opposite to the approaching vehicle.

4. The vehicle information system according to claim 1, wherein:

the traveling vehicle detecting means includes a plurality of sensors installed in the loop intersection in correspondence with at least the plurality of the roads;

the notifying means includes a plurality of display units installed on the loop intersection; and the control means causes one of the plurality of display units to display the traveling vehicle when the traveling vehicle is detected by one of the plurality of sensors which is installed opposite to the one of the plurality of sensors.

5. The vehicle information system according to claim 1, wherein:

the notifying means is provided for each of the plurality of roads to be viewed from the approaching vehicle.

6. The vehicle information system according to claim 1, further comprising:

approaching vehicle detecting means for detecting an approaching vehicle that is going to enter the loop intersection from one of the plurality of roads, wherein the notifying means which, when the approaching vehicle detecting means detects the approaching vehicle, notifies another approaching vehicle which is going to enter the loop intersection from another road of the plurality of roads which is neighboring to the one of the plurality of roads on which the approaching vehicle is detected in a predetermined traveling direction in the loop intersection.

7. The vehicle information system according to claim 1, further comprising:

transmission means installed on the plurality of roads for transmitting information indicative of detection of the traveling vehicle by the traveling vehicle detecting means; and receiving means installed on a vehicle for receiving the information transmitted from the transmission means, wherein the notifying means includes a notifying unit installed in the vehicle for notifying the information received by the receiving means.

8. A vehicle information system for a loop intersection connected to a plurality of roads, the vehicle information system comprising;

approaching vehicle detecting means for detecting an approaching vehicle that is going to enter the loop intersection from one of the plurality of roads, wherein the loop intersection is a traffic circle in a rotary shape; and notifying means which, when the approaching vehicle detecting means detects the approaching vehicle, notifies another approaching vehicle which is going to enter the loop intersection from another road of the plurality of roads which is neighboring to the one of the plurality of roads on which the approaching vehicle is detected in a predetermined traveling direction in the loop intersection, wherein the loop intersection corresponds to a traffic rule defining that the traveling vehicle traveling in the loop intersection has priority over the approaching vehicle entering into the loop intersection so that the traveling vehicle is not affected by the approaching vehicle.

9. The vehicle information system according to claim 7, wherein the notifying means includes billboard means that is installed in the loop intersection and is equipped with display means for providing a visual display of the approaching vehicle.

10. The vehicle information system according to claim 8, further comprising:

transmission means installed on the plurality of roads for transmitting information representing detection of a vehicle by the approaching vehicle detecting means; and receiving means for receiving information transmitted from the transmission means, wherein the notifying means includes a display unit installed in the another approaching vehicle.

11. The vehicle information system according to claim 7, wherein:

the approaching vehicle detecting means includes a plurality of sensors installed on the plurality of roads outside the loop intersection, respectively.

* * * * *